US010273911B2

(12) United States Patent
Sasaki et al.

(10) Patent No.: US 10,273,911 B2
(45) Date of Patent: Apr. 30, 2019

(54) EGR CONTROL DEVICE

(71) Applicant: SUBARU CORPORATION, Tokyo (JP)

(72) Inventors: Taku Sasaki, Tokyo (JP); Hiroshi Oiwa, Tokyo (JP)

(73) Assignee: SUBARU CORPORATION, Tokyo (JP)

( * ) Notice: Subject to any disclaimer, the term of this patent is extended or adjusted under 35 U.S.C. 154(b) by 0 days.

(21) Appl. No.: 15/850,627

(22) Filed: Dec. 21, 2017

(65) Prior Publication Data

US 2018/0283327 A1 Oct. 4, 2018

(30) Foreign Application Priority Data

Mar. 29, 2017 (JP) ..... 2017-064196

(51) Int. Cl.

| | |
|---|---|
| ***F02D 45/00*** | (2006.01) |
| ***F02M 26/64*** | (2016.01) |
| ***F02M 26/48*** | (2016.01) |
| ***F02M 26/47*** | (2016.01) |
| ***F02M 26/21*** | (2016.01) |

(52) U.S. Cl.

CPC ..... *F02M 26/64* (2016.02); *F02M 26/21* (2016.02); *F02M 26/47* (2016.02); *F02M 26/48* (2016.02)

(58) Field of Classification Search

CPC ..... F02M 26/21; F02M 26/47; F02M 26/48; F02M 26/64

See application file for complete search history.

(56) References Cited

U.S. PATENT DOCUMENTS

2004/0084031 A1 5/2004 Ito et al.
2008/0073605 A1* 3/2008 Ishigaki ..... F16K 1/36 251/12

(Continued)

FOREIGN PATENT DOCUMENTS

JP 2002-089338 A 3/2002
JP 2004-150343 A 5/2004

(Continued)

OTHER PUBLICATIONS

Reason for Rejection dated Jul. 31, 2018 during the prosecution of Japanese Patent Application JP2017-064196.

*Primary Examiner* — Hieu T Vo
*Assistant Examiner* — Arnold Castro
(74) *Attorney, Agent, or Firm* — Troutman Sanders LLP

(57) ABSTRACT

An EGR control device includes: a tumble generation valve, a recirculation passage, an EGR valve, an EGR valve opening degree deriving unit, and an EGR valve control unit. The tumble generation valve is configured to adjust a passage area of an intake passage of an engine. The recirculation passage is configured to recirculate an exhaust gas from an exhaust passage of the engine to the intake passage. The EGR valve is disposed on the recirculation passage and configured to open and close the recirculation passage. The EGR valve opening degree deriving unit is configured to derive an opening degree of the EGR valve on a basis of an engine speed, an engine load, and a tumble generation valve opening and closing rate. The EGR valve control unit is configured to drive and control the EGR valve to achieve the opening degree derived by the EGR valve opening degree deriving unit.

2 Claims, 3 Drawing Sheets

(56) References Cited

U.S. PATENT DOCUMENTS

| | | | | |
|---|---|---|---|---|
| 2011/0131975 | A1* | 6/2011 | Styles | F02D 9/16 60/602 |
| 2011/0132322 | A1* | 6/2011 | Boyer | F02B 47/08 123/337 |

FOREIGN PATENT DOCUMENTS

| | | | |
|---|---|---|---|
| JP | 2007-291990 | A | 11/2007 |
| JP | 2012-031740 | A | 2/2012 |

* cited by examiner

EGR CONTROL DEVICE

CROSS-REFERENCE TO RELATED APPLICATIONS

The present application claims priority from Japanese Patent Application No. 2017-064196 filed on Mar. 29, 2017, the entire contents of which are hereby incorporated by reference.

TECHNICAL FIELD

The present invention relates to an EGR control device for controlling an EGR valve of an EGR device.

BACKGROUND

Up to now, as a method of controlling an EGR valve, a differential pressure before and after the EGR valve is measured by a differential pressure sensor, and the EGR valve is controlled based on a measurement result (for instance, Japanese Unexamined Application Publication (JP-A) No. 2004-150343.

However, the method disclosed in JP-A No. 2004-150343 suffers from such a problem that the differential pressure sensor that measures the differential pressure before and after the EGR valve needs to be disposed in the vicinity of the EGR valve, resulting in a complicated configuration.

SUMMARY

Therefore, it is desirable to provide an EGR control device capable of appropriately controlling an EGR valve with a simple configuration.

An aspect of the present invention provides an EGR control device including: a tumble generation valve that is configured to adjust a passage area of an intake passage of an engine; a recirculation passage that is configured to recirculate an exhaust gas from an exhaust passage of the engine to the intake passage; an EGR valve that is disposed on the recirculation passage and configured to open and close the recirculation passage; an EGR valve opening degree deriving unit which is configured to derive an opening degree of the EGR valve on a basis of an engine speed, an engine load, and a tumble generation valve opening and closing rate; and an EGR valve control unit that is configured to drive and control the EGR valve to achieve the opening degree derived by the EGR valve opening degree deriving unit.

DETAILED DESCRIPTION

Figure 1:
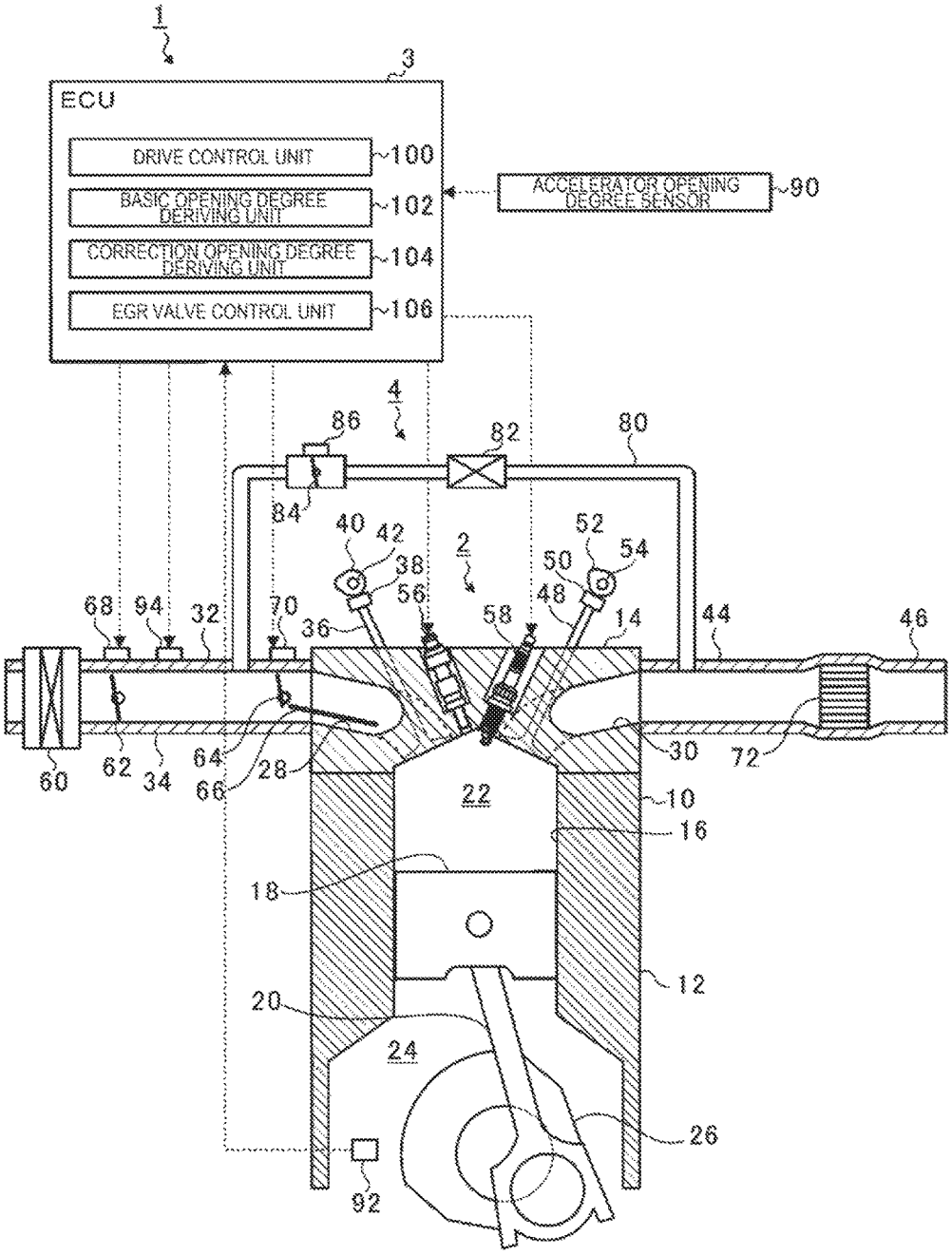
FIG. 1 is a schematic diagram illustrating a configuration of an EGR control device.

A preferred example of the present invention will now be described in detail with reference to the accompanying drawings. The dimensions, materials, specific numerical values, and the like illustrated in such an example are merely for facilitating understanding of the invention, and do not limit the present invention unless otherwise noted. In the present specification and drawings, elements having substantially the same function and configuration are denoted by the same reference numerals and redundant explanations are omitted, and elements not directly related to the present invention are omitted.

FIG. 1 is a schematic diagram illustrating a configuration of an EGR (Exhaust Gas Recirculation) control device 1. However, in the following description, configurations and processing related to the present example will be described in detail, and configurations and processing unrelated to the present example will be omitted from the description.

As illustrated in FIG. 1, the EGR control device 1 is provided with an engine 2 and an ECU 3 (Engine Control Unit), and the entire engine 2 is driven and controlled by the ECU 3.

The engine 2 is provided with a cylinder block 10, a crankcase 12 that is integrated with the cylinder block 10, and a cylinder head 14 that is coupled to the cylinder block 10.

A plurality of cylinders 16 are formed in the cylinder block 10, and a piston 18 is slidably supported by a connecting rod 20 in the cylinder 16. A space surrounded by the cylinder head 14, the cylinder 16, and a crown surface of the piston 18 is defined as a combustion chamber 22.

A crank chamber 24 is provided in the engine 2 by the crankcase 12, and a crankshaft 26 is rotatably supported in the crank chamber 24. The piston 18 is coupled to the crankshaft 26 through the connecting rod 20.

An intake port 28 and an exhaust port 30 are provided in the cylinder head 14 so as to communicate with the combustion chamber 22.

An intake passage 34 including an intake manifold 32 is coupled to the intake port 28. In the intake port 28, one opening is provided on an upstream side of an intake air facing the intake manifold 32, and two openings are provided on a downstream side facing the combustion chamber 22. The passage is branched into two in the middle of the passage from the upstream toward the downstream.

A tip end of the intake valve 36 is located between the intake port 28 and the combustion chamber 22. A cam 42 fixed to the intake camshaft 40 is abutted against an end of the intake valve 36 through a rocker arm 38. The intake valve 36 opens and closes the intake port 28 for the combustion chamber 22 as the intake camshaft 40 rotates.

An exhaust passage 46 including an exhaust manifold 44 is coupled to the exhaust port 30. In the exhaust port 30, two openings are provided on an upstream side of an exhaust air facing the combustion chamber 22, and one opening is provided on a downstream side facing the exhaust manifold 44. The passages are merged into one in the middle of the passage from the upstream toward the downstream.

A tip end of the exhaust valve 48 is located between the exhaust port 30 and the combustion chamber 22. A cam 54 fixed to the exhaust camshaft 52 is abutted against an end of the exhaust valve 48 through a rocker arm 50. The exhaust valve 48 opens and closes the exhaust port 30 for the combustion chamber 22 as the exhaust camshaft 52 rotates.

An injector 56 and an ignition plug 58 are provided in the cylinder head 14 so that tips of the injector 56 and the ignition plug 58 are positioned within the combustion chamber 22, and a fuel is injected from the injector 56 toward an air flowing into the combustion chamber 22 through the intake port 28. An air-fuel mixture is ignited by the ignition plug 58 at a predetermined timing and combusted. With such combustion, the piston 18 reciprocates in the cylinder 16, and a reciprocating motion of the piston 18 is converted into a rotational motion of the crankshaft 26 through the connecting rod 20.

In the intake passage 34, an air cleaner 60, a throttle valve 62, a TGV (Tumble Generation Valve) 64, and a partition wall 66 are provided in the stated order from the upstream side. The air cleaner 60 removes foreign matter to be mixed with the air suctioned from the outside air. The throttle valve 62 is opened and closed by an actuator 68 according to the opening degree of an accelerator (not shown), and adjusts the amount of air to be sent to the combustion chamber 22.

The TGV 64 is driven to open and close by the actuator 70, and opens and closes one of the passages partitioned by the partition wall 66. In other words, the TGV 64 adjusts a passage area of the intake port 28 (the intake passage 34). The partition wall 66 extends along an air flow direction within the intake port 28, and divides the intake port 28 into two passages.

As illustrated in FIG. 1, when the TGV 64 is closed, when one of the passages partitioned by the partition wall 66 is closed by the TGV 64, the air guided to the air intake passage passes through the other passage partitioned by the partition wall 66, and is guided to the combustion chamber 22.

In the engine 2, when an engine load (accelerator opening degree) is small and an intake air flow rate is small, the opening degree of the TGV 64 is throttled, and most of the intake air passes through the other passage divided by the partition wall 66. In this manner, in the engine 2, the air having the increased flow rate flows into the combustion chamber 22, a strong tumble flow is generated in the combustion chamber 22, rapid combustion of the fuel is realized, and an improvement in fuel economy and combustion stability is enabled.

A catalyst 72 is provided in the exhaust passage 46. The catalyst 72 is, for instance, a three-way catalyst and includes platinum (Pt), palladium (Pd), and rhodium (Rh), and removes hydrocarbons (HC), carbon monoxide (CO), and nitrogen oxides (NOx) contained in an exhaust gas discharged from the combustion chamber 22.

Further, the engine 2 is provided with an EGR device 4. The EGR device 4 is provided with a recirculation passage 80 that communicates the intake passage 34 with the exhaust passage 46, and recirculates a part of the exhaust gas flowing through the exhaust passage 46 to the intake passage 34. The recirculation passage 80 is provided with an EGR cooler 82 that lowers a temperature of the exhaust gas and an EGR valve 84 that controls a flow rate of the exhaust gas flowing through the reflow passage 80. The EGR valve 84 is, for instance, a butterfly valve, and an opening degree of the EGR valve 84 is varied by a stepping motor 86. In the following description, the exhaust gas flowing through the recirculation passage 80 is also referred to as EGR gas.

Also, the EGR control device 1 is provided with an accelerator opening degree sensor 90, a crank angle sensor 92, and a flow meter 94. The accelerator opening degree sensor 90 detects the depression amount of an accelerator pedal. The crank angle sensor 92 is provided in the vicinity of the crankshaft 26, and outputs a pulse signal each time the crankshaft 26 rotates by a predetermined angle. The flow meter 94 is provided downstream of the throttle valve 62 in the intake passage 34, and detects the intake air amount that passes through the throttle valve 62 and is supplied to the combustion chamber 22.

The ECU 3 is a microcomputer including a central processing unit (CPU), a ROM in which programs and the like are stored, a RAM as a work area, and the like, and integrally controls the engine 2 and the EGR device 4. In the present example, when controlling the engine 2 and the EGR device 4, the ECU 3 functions as a drive control unit 100, a basic opening degree deriving unit 102, a correction opening degree deriving unit 104, and an EGR valve control unit 106. In addition, the basic opening degree deriving unit 102 and the correction opening degree deriving unit 104 collectively function as an EGR valve opening degree deriving unit.

The drive control unit 100 derives a current engine speed based on a pulse signal detected by the crank angle sensor 92. The drive control unit 100 derives a target torque and a target engine speed with reference to a map stored in advance based on the derived engine speed and the accelerator opening degree (engine load) detected by the accelerator opening degree sensor 90.

Further, the drive control unit 100 determines a target air amount to be supplied to each cylinder 16 based on the derived target engine speed and target torque, and determines a target throttle opening degree and a target TGV opening and closing rate based on the determined target air amount. In this case, the target TGV opening and closing rate is determined to be either one of a closed state in which the TGV 64 is closed or an opened state in which the TGV 64 is open.

The drive control unit 100 drives the actuator 68 so that the throttle valve 62 opens with the determined target throttle opening degree, and drives the actuator 70 so that the TGV 64 opens with the determined target TGV opening and closing rate.

Further, the drive control unit 100 determines the fuel amount to be, for instance, a theoretical air-fuel ratio (X=1) as a target injection amount, based on the determined target air amount, and determines a target injection timing and a target injection period of the injector 56 in order to inject the fuel of the determined target injection amount from the injector 56. The drive control unit 100 drives the injector 56 at the determined target injection timing and in the target injection period, thereby causing the injector 56 to inject the target injection amount of fuel.

Further, the drive control unit 100 determines the target ignition timing of the ignition plug 58 based on the derived target engine speed and the pulse signal detected by the crank angle sensor 92. Then, the drive control unit 100 ignites the ignition plug 58 at the determined target ignition timing.

The basic opening degree deriving unit 102 derives a target EGR rate indicating a ratio of the EGR gas to a total amount of the intake air and the EGR gas introduced into the combustion chamber 22, based on the engine speed, the engine load and the TGV opening and closing rate.

In this case, since a combustion situation (temperature and pressure) of the air-fuel mixture in the combustion chamber 22 is different between a case in which the TGV 64 is in the closed state and a case in which the TGV 64 is in the opened state, the target EGR rate to be supplied (recirculated) to the combustion chamber 22 is also different between those cases. Therefore, two target EGR rate maps in the case where the TGV 64 is in the closed state and in the case where the TGV 64 is in the opened state are provided in the ECU 3 (RAM) in advance. A target EGR rate for the engine speed and the engine load is indicated in the target EGR rate maps.

When the TGV 64 is in the closed state, the basic opening degree deriving unit 102 derives the target EGR rate with reference to the target EGR rate map for the case where the TGV 64 is in the closed state based on the engine speed and the engine load. When the TGV 64 is in the opened state, the basic opening degree deriving unit 102 derives the target EGR rate with reference to the target EGR rate map for the case where the TGV 64 is in the opened state based on the engine speed and the engine load.

Further, when the TGV 64 is transitioning from the opened state to the closed state or from the closed state to the opened state, the basic opening degree deriving unit 102 derives the target EGR rates in the cases in which the TGV 64 is in the closed state and in the opened state, with reference to the two target EGR rate maps, respectively, based on the engine speed and the engine load. Then, the basic opening degree deriving unit 102 linearly interpolates the derived two target EGR rates according to the opening degree of the TGV 64, thereby deriving the target EGR rate.

Subsequently, the basic opening degree deriving unit 102 derives a target EGR flow rate to be recirculated to the intake passage 34, based on the derived target EGR rate and the intake air amount detected by the flow meter 94. Thereafter, the basic opening degree deriving unit 102 derives the opening degree of the EGR valve 84 for recirculating the target EGR flow rate to the intake passage 34 as the basic EGR opening degree.

In this case, on the premise that nothing is attached to the EGR valve 84, the basic EGR opening degree is set to a value at which the EGR gas at the target EGR flow rate is recirculated when the EGR valve 84 is opened with that opening degree. However, various materials (deposits) contained in the EGR gas adhere to the EGR valve 84 or the periphery of the EGR valve 84. When the deposit adheres to the EGR valve 84 or the periphery of the EGR valve 84, even if the EGR valve 84 is opened with the basic EGR opening degree, an opening area of the EGR valve 84 changes due to deposition of deposits, and the flow rate of the EGR gas is different from the target EGR flow rate.

Therefore, the opening degree of the EGR valve 84 is subjected to a feedback control based on the differential pressure before and after the EGR valve 84, as a result of which the flow rate of the EGR gas is set to the target EGR flow rate even when the deposit adheres to the EGR valve 84. However, if it is attempted to measure the differential pressure before and after the EGR valve 84 with the differential pressure sensor, the configuration becomes complicated for placement of the differential pressure sensor, and the cost also increases.

Therefore, in the present example, the differential pressure before and after the EGR valve 84 is estimated based on the engine speed, the engine load, and the TGV opening and closing rate, thereby being capable of simplifying the configuration and reducing the cost.

The correction opening degree deriving unit 104 derives the target differential pressure from the target EGR flow rate with reference to a table presenting a relationship between the target EGR flow rate obtained in advance through experiment and the target differential pressure before and after the EGR valve 84. It should be noted that the target differential pressure may be derived with reference to the target differential pressure map based on the engine speed and the engine load. In the target differential pressure map, the target differential pressure is indicated with respect to the engine speed and the engine load.

In addition, the correction opening degree deriving unit 104 derives (estimates) the actual differential pressure before and after the EGR valve 84 based on the engine speed, the engine load, and the TGV opening and closing rate. In this case, as described above, since the combustion state varies depending on the TGV opening and closing rate, which affects the characteristics such as the amount of exhaust gas, the speed, temperature, and components, the actual differential pressure before and after the EGR valve 84 is affected by the TGV opening and closing rate. Therefore, when deriving the actual differential pressure before and after the EGR valve 84, the TGV opening and closing rate is used as a parameter, thereby being capable of deriving the actual differential pressure with high precision.

Specifically, similarly to the case of deriving the target EGR rate, the ECU 3 is provided with two actual differential pressure maps in the case where the TGV 64 is in the closed state and the case in which the TGV 64 is in the opened state. The actual differential pressure map indicates the actual differential pressure with respect to the engine speed and the engine load.

When the TGV 64 is in the closed state, the correction opening degree deriving unit 104 derives the actual differential pressure with reference to the actual differential pressure map for the case where the TGV 64 is in the closed state based on the engine speed and the engine load. Further, when the TGV 64 is in the opened state, the correction opening degree deriving unit 104 derives the actual differential pressure with reference to the actual differential pressure map for the case where the TGV 64 is in the opened state, based on the engine speed and the engine load.

Further, when the TGV 64 is transitioning, the correction opening degree deriving unit 104 derives the actual differential pressures in the cases where the TGV 64 is in the closed state and in the opened state with reference to the respective two actual differential pressure maps based on the engine speed and the engine load. Then, the correction opening degree deriving unit 104 linearly interpolates the derived two actual differential pressures according to the opening degree of the TGV 64, thereby deriving the actual differential pressure.

Figure 2:
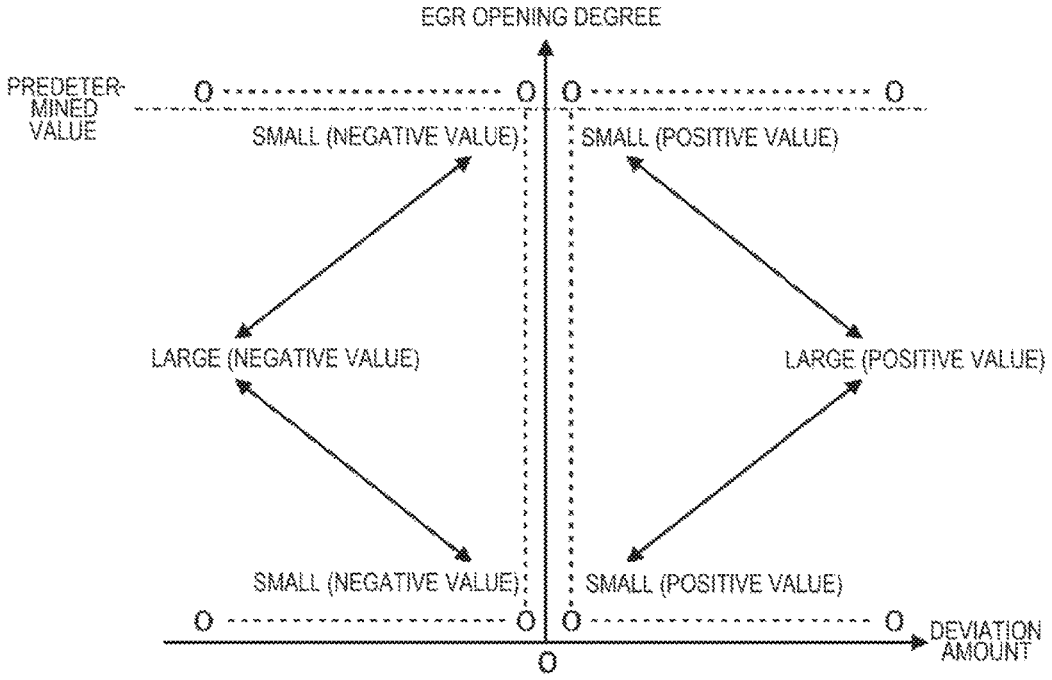
FIG. 2 is a diagram illustrating a correction opening degree map indicating a correction opening degree to a deviation amount and an EGR opening degree.

FIG. 2 is a diagram illustrating a correction opening degree map indicating a correction opening degree to a deviation amount and an EGR opening degree. In FIG. 2, "large" and "small" indicate magnitude relationships with absolute values. For instance, "large (negative value)" and "small (negative value)" are negative values, which indicate that the absolute value of "large (negative value)" is larger than that of "small (negative value)".

Upon deriving the target differential pressure and the actual differential pressure, the correction opening degree deriving unit 104 derives the deviation amount of the actual differential pressure from the target differential pressure by subtracting the actual differential pressure from the target differential pressure. Then, the correction opening degree deriving unit 104 derives the correction opening degree with reference to the correction opening degree map illustrated in FIG. 2 based on the derived deviation amount and the current EGR opening degree.

In the correction opening degree map, the correction opening degree is set to 0 when the EGR opening degree is 0° and when the EGR opening degree is equal to or more than a predetermined value that can be regarded as having no influence of deposit. When the EGR opening degree is in a range from 0° to less than the predetermined value, since the influence of the deposit increases more toward the center, the correction opening degree is also set to a large value.

In addition, in the correction opening degree map, the correction opening degree is set to 0 as a dead zone in order to reduce an excessive feedback control when the deviation amount is around 0. Then, as the deviation amount becomes larger than 0, that is, the actual differential pressure becomes smaller than the target differential pressure, the correction opening degree is set to become gradually larger from 0.

Further, as the deviation amount becomes smaller than 0, that is, as the actual differential pressure becomes larger than the target differential pressure, the correction opening degree is set to a value gradually decreased from 0 (an absolute value of the negative value increases).

The EGR valve control unit 106 corrects (adds) the basic EGR opening degree derived by the basic opening degree deriving unit 102 with the correction opening degree derived by the correction opening degree deriving unit 104, thereby deriving a final EGR opening degree. Then, the EGR valve control unit 106 drives the stepping motor 86 so as to open the EGR valve 84 with the final EGR opening degree.

Figure 3:
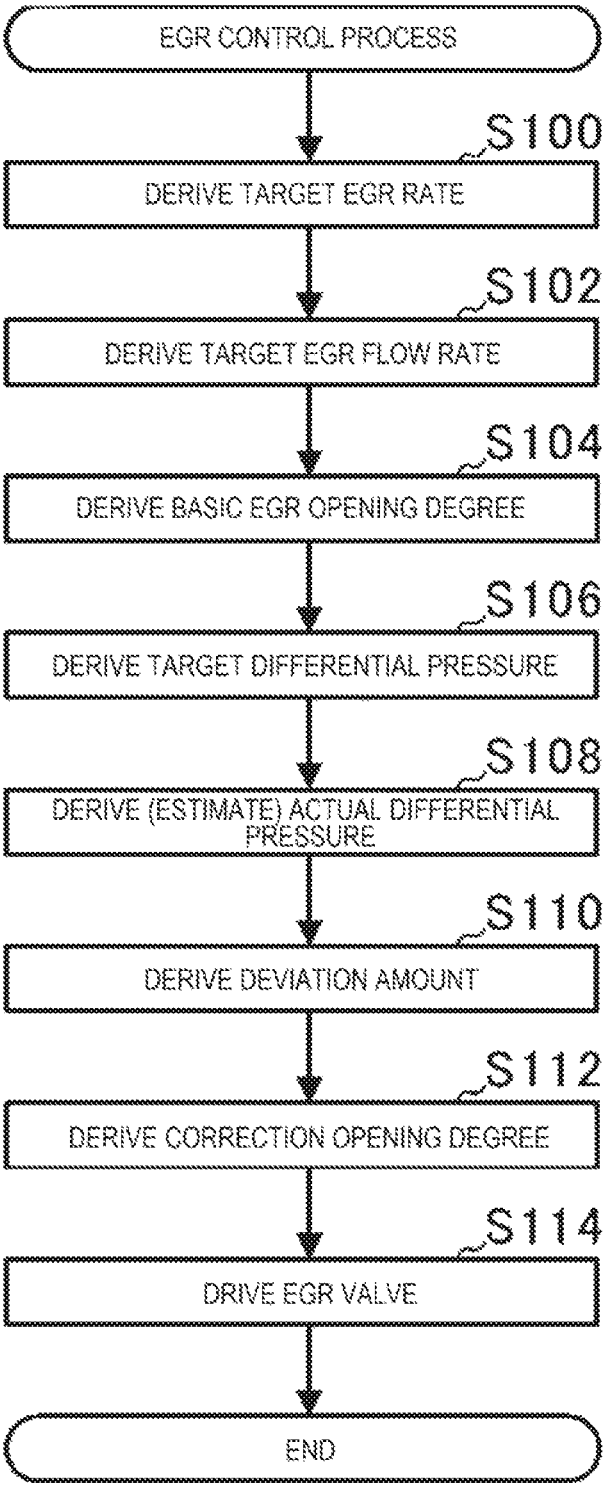
FIG. 3 is a flowchart illustrating an EGR control process.

FIG. 3 is a flowchart illustrating an EGR control process. The ECU 3 executes an EGR control process illustrated in FIG. 3 when controlling the EGR valve 84. First, the basic opening degree deriving unit 102 derives the target EGR rate based on the engine speed, the engine load, and the TGV opening and closing rate (S100).

Subsequently, the basic opening degree deriving unit 102 derives a target EGR flow rate, based on the derived target EGR rate and the intake air amount detected by the flow meter 94 (S102). Thereafter, the basic opening degree deriving unit 102 derives the opening degree of the EGR valve 84 for recirculating the target EGR flow rate to the intake passage 34 as the basic EGR opening degree (S104).

Thereafter, the correction opening degree deriving unit 104 derives the target differential pressure before and after the EGR valve 84 with reference to a table presenting a relationship between the target EGR flow rate obtained in advance through experiment and the target differential pressure based on the target EGR flow rate (S106).

Subsequently, the correction opening degree deriving unit 104 derives (estimates) the actual differential pressure before and after the EGR valve 84 with reference to the actual differential pressure map based on the engine speed, the engine load, and the TGV opening and closing rate (S108).

The correction opening degree deriving unit 104 derives the deviation amount of the actual differential pressure from the target differential pressure by subtracting the actual differential pressure from the target differential pressure (S110). In addition, the correction opening degree deriving unit 104 derives the correction opening degree with reference to the correction opening degree map based on the derived deviation amount and the current EGR opening degree (S112).

Thereafter, the EGR valve control unit 106 corrects (adds) the basic EGR opening degree derived in S104 with the correction opening degree derived in S112, thereby deriving a final EGR opening degree. Then, the EGR valve control unit 106 drives the stepping motor 86 so as to open the EGR valve 84 with the final EGR opening degree (S114).

As described above, the EGR control device 1 derives the final EGR opening degree based on the engine speed, the engine load, and the TGV opening and closing rate. At this time, since the actual differential pressure is derived based on the engine speed, the engine load, and the TGV opening and closing rate, there is no need to provide the differential pressure sensor, and the actual differential pressure can be accurately derived with a simple configuration.

As a result, since the EGR control device 1 can accurately derive the correction opening degree with respect to the basic EGR opening degree, the target EGR flow rate can be satisfied even if a deposit is attached to the EGR valve 84. Thus, the EGR control device 1 can improve a fuel consumption performance and an exhaust gas performance, and can improve surge immunity.

Although a preferred example of the present invention with reference to the accompanying drawings has been described, the present invention is not limited to such examples. Provided a person has ordinary knowledge in the technical field to which the example of the present invention pertains, within the scope of the technical idea described in the claims, the example of the present invention is intended to cover various modifications and applications, and such modifications are intended to fall within the technical scope of the present invention.

For instance, in the above example, after the target EGR rate and the target EGR flow rate have been derived, the basic EGR opening degree is derived. However, the basic EGR opening degree may be directly derived based on the engine speed, the engine load and the TGV opening and closing rate.

Further, in the above example, the TGV 64 is controlled in either of the opened state or the closed state, but the TGV 64 may be controllable with an intermediate opening degree.

According to the example of the present invention, the EGR valve can be appropriately controlled with a simple configuration.

The invention claimed is:

1. An EGR control device comprising:

a tumble generation valve that is configured to adjust a passage area of an intake passage of an engine;

a recirculation passage that is configured to recirculate an exhaust gas from an exhaust passage of the engine to the intake passage;

an EGR valve that is disposed on the recirculation passage and configured to open and close the recirculation passage;

an EGR valve opening degree deriving unit that is configured to derive an opening degree of the EGR valve on a basis of an engine speed, an engine load, and a tumble generation valve opening and closing rate; and an EGR valve control unit that is configured to drive and control the EGR valve to achieve the opening degree derived by the EGR valve opening degree deriving unit.

2. The EGR control device according to claim 1, wherein the EGR valve opening degree deriving unit comprises:

a basic opening degree deriving unit that is configured to derive a basic EGR opening degree of the EGR valve on a basis of the engine speed and the engine load; and a correction opening degree deriving unit that is configured to estimate an actual differential pressure before and after the EGR valve on a basis of the engine speed, the engine load, and the tumble generation valve opening and closing rate, and derive a correction opening degree for the basic EGR opening degree on a basis of the estimated actual differential pressure, and the EGR valve control unit is configured to drive and control the EGR valve to obtain an opening degree into which the basic EGR opening degree is corrected by the correction opening degree.

* * * * *